US006502872B1

(12) United States Patent
Molzer

(10) Patent No.: US 6,502,872 B1
(45) **Date of Patent: *Jan. 7, 2003**

(54) LATCH ASSEMBLY

(75) Inventor: Klaus Molzer, Nassjo (SE)

(73) Assignee: Austin Hardware, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/415,296

(22) Filed: Oct. 8, 1999

Related U.S. Application Data

(60) Provisional application No. 60/103,714, filed on Oct. 9, 1998.

(51) Int. Cl.[7] ..... E05B 3/00

(52) U.S. Cl. ..... 292/336.3; 70/210

(58) Field of Search ..... 292/200, 202, 292/205, 207, 210, 226, 336, 3, DIG. 30, DIG. 62; 70/208–210, 212, DIG. 63

(56) References Cited

U.S. PATENT DOCUMENTS

| | | | | |
|---|---|---|---|---|
| 1,812,334 | A | 6/1931 | Gloekler | |
| 2,707,121 | A | 4/1955 | Behnke | 292/228 |
| 2,851,871 | A | 9/1958 | Newell | 70/150 |
| 2,949,328 | A | 8/1960 | Kaiser | 292/207 |
| 3,159,994 | A | 12/1964 | Schulz | 70/146 |
| 4,031,730 | A | 6/1977 | Kern | 70/419 |
| 4,057,003 | A | 11/1977 | Atchisson | 89/138 |
| 4,099,593 | A | 7/1978 | Schultz | 180/114 |
| 4,237,710 | A | 12/1980 | Cardoza | 70/108 |
| 4,470,277 | A | 9/1984 | Uyeda | 70/118 |
| 4,502,720 | A | 3/1985 | Fayerman et al. | 292/348 |
| 4,583,775 | A | 4/1986 | Bisbing | 292/64 |
| 4,623,178 | A | 11/1986 | Geringer et al. | 292/173 |
| 4,732,418 | A | 3/1988 | Crown et al. | 292/207 |
| 4,763,935 | A | 8/1988 | Bisbing | 292/66 |
| 4,827,614 | A | 5/1989 | Mitchell | 30/151 |
| 4,941,336 | A | 7/1990 | Steckler | 70/365 |
| 4,979,767 | A | 12/1990 | Lin | 292/336.3 |

(List continued on next page.)

*Primary Examiner*—Gary Estremsky
(74) *Attorney, Agent, or Firm*—Vidas, Arrett & Steinkraus P.A.

(57) ABSTRACT

A latching assembly that requires three distinct operations must be performed with two hands to allow the handle of the latch assembly to be rotated to unlock a door from a door frame. The assembly provides substantial flexibilities in installation. A base portion having a sleeve which defines an aperture is secured to a door and receives a handle portion with a shaft attached, the shaft extending through the aperture defined by the sleeve. Cooperative rotation restriction portions on the handle and on the base portion restrict the motion of the handle to a limited rotation range. The limited rotation range may be altered by selectively positioning a key guide in one of the cooperative rotation restriction portions. A first release mechanism comprising a trigger portion which extends from the handle and a detent which engages a detent opening in the base portion requires depression of the trigger portion before rotation of the handle to an unlatched position. The detent mechanism is within the handle and a cap containes and encloses the detent mechanism. The cap portion has a bore which receives a second release mechanism which has a shaft portion that may be exteriorly manipulated to move an obstructing member into and out of an obstructing relation with the detent. Thus, the second release mechanism must be manipulated to allow release of the trigger portion which must be depressed to allow rotation of the handle. The cap portion is secured in the handle by screws or other threaded members extending from the handle base portion interface into the cap.

16 Claims, 9 Drawing Sheets

U.S. PATENT DOCUMENTS

| | | | | |
|---|---|---|---|---|
| 5,172,944 | A | 12/1992 | Munich et al. | 292/39 |
| 5,184,853 | A | 2/1993 | Whatley | 292/205 |
| 5,236,234 | A | 8/1993 | Norman | 292/201 |
| 5,259,091 | A | 11/1993 | Mordick | 16/262 |
| D343,347 | S | 1/1994 | Lau et al. | D8/301 |
| 5,292,189 | A | 3/1994 | Lau et al. | 312/265.3 |
| 5,299,597 | A | 4/1994 | Fort et al. | 137/385 |
| 5,339,659 | A | 8/1994 | Guzzinati | 70/120 |
| 5,390,517 | A | 2/1995 | Ymada | 70/210 |
| D360,345 | S | 7/1995 | Swan et al. | D8/308 |
| 5,469,725 | A | 11/1995 | Yamada | 70/208 |
| 5,474,339 | A | 12/1995 | Johnson | 292/216 |
| 5,481,889 | A | 1/1996 | Richard et al. | 70/118 |
| 5,509,703 | A | 4/1996 | Lau et al. | 292/1 |
| D371,300 | S | 7/1996 | Mordick | D8/343 |
| 5,577,782 | A | 11/1996 | Johnson et al. | 292/216 |
| 5,582,042 | A | 12/1996 | Mordick | 70/14 |
| 5,584,515 | A | 12/1996 | Silye | 292/201 |
| 5,595,408 | A | 1/1997 | Jeche | 292/37 |
| 5,621,251 | A | 4/1997 | Yamazaki | 307/10.2 |
| 5,630,632 | A | 5/1997 | Swan | 292/240 |
| 5,632,070 | A | 5/1997 | Wakabayashi | 24/419 |
| 5,634,357 | A | 6/1997 | Nutter et al. | 70/210 |
| 5,642,909 | A | 7/1997 | Swan et al. | 292/39 |
| 5,664,448 | A | 9/1997 | Swan et al. | 70/224 |
| 5,666,695 | A | 9/1997 | Jergers et al. | 16/381 |
| D385,768 | S | 11/1997 | Nutter et al. | D8/308 |
| 5,683,005 | A | 11/1997 | Mordick | 220/3.7 |
| 5,700,044 | A | 12/1997 | Wartian | 292/336.3 |
| 5,704,100 | A | 1/1998 | Swan | 24/656 |
| D391,143 | S | 2/1998 | Jancsek | D8/338 |
| 5,722,121 | A | 3/1998 | Lau et al. | 16/381 |
| D396,397 | S | 7/1998 | Swan | D8/331 |
| 5,775,145 | A | 7/1998 | Kasper | 70/367 |
| 5,803,655 | A | 9/1998 | Furuya | 403/398 |
| 5,806,351 | A | 9/1998 | Learnahan | 70/56 |
| D400,076 | S | 10/1998 | Jancsek et al. | D8/331 |
| 5,862,690 | A | 1/1999 | Jancek | 70/224 |
| 5,879,035 | A | 3/1999 | Jancsek et al. | 292/202 |
| 5,899,508 | A | 5/1999 | Cetnar et al. | 292/216 |
| D411,433 | S | 6/1999 | Swan et al. | D8/306 |
| 5,927,014 | A | 7/1999 | Goldenberg | 49/182 |
| 6,019,402 | A | 2/2000 | Arabia, Jr. et al. | 292/216 |
| 6,045,168 | A | 4/2000 | Johnson et al. | 292/216 |
| 6,053,543 | A | 4/2000 | Arabia, Jr. et al. | 292/201 |
| 6,067,826 | A | 5/2000 | Holloway et al. | 70/278.3 |
| 6,131,967 | A | 10/2000 | Kondo et al. | 292/201 |
| 6,145,354 | A | 11/2000 | Kondo et al. | 70/279.1 |
| 6,257,154 | B1 | 7/2001 | Kasper | 109/73 |

LATCH ASSEMBLY

PRIORITY CLAIM

Priority is claimed to co-pending Provisional Patent Application Ser. No. 60/103,714 filed Oct. 9, 1998, and entitled "LATCH ASSEMBLY".

BACKGROUND OF THE INVENTION

This invention relates to latches and more particularly relates to latch assemblies utilizing handles and secondary handle release mechanisms for use with cabinets and the like.

Latch assemblies with handles are known which are lockable by utilization of an internal lock cylinder which prevents the handle from rotating. Typically these latch assemblies can be locked and unlocked and remain in the unlocked position whereby the handle and door attached thereto may be opened with one hand. Standards adopted in the telecommunications industries require that two hands be utilized to operate certain cabinet latching assemblies. There has been minimal development of effective and convenient latching assemblies which have this feature. Additional locking features to accommodate a padlock are also desirable as the primary locking means or a secondary locking means on such latching assemblies. Prior art latch assemblies, particularly locking latch assemblies, normally lack flexibility in being adaptable for varying applications, for example a left or right hand door.

SUMMARY OF THE INVENTION

The present invention provides a latching assembly that requires three distinct operations which must be performed with two hands to allow the handle of the latch assembly to be rotated to unlock a cabinet door or the like. Moreover, the design allows substantial flexibilities in installation.

A base portion with a sleeve is secured to a door and receives a handle portion with a shaft attached, the shaft extending through the sleeve. Cooperative rotation restriction portions on the handle and on the base portion restrict the motion of the handle to a limited rotation range. Said limited rotation range may be altered by selectively moving a key guide in one of the cooperative rotation restriction portions. A first release mechanism comprising a trigger portion which extends from the handle and a detent mechanism which engages an opening in the support portion which requires depression of the trigger portion before rotation of the handle to an unlatched position. The detent mechanism is within the handle and a cap contains and encloses in the detent mechanism. The cap portion has a bore which receives a second release mechanism which has a shaft portion that may be exteriorly manipulated to move an obstructive member into and out of an obstructing relation with the detent. Thus, the second release mechanism must be manipulated to allow release of the trigger portion which must be depressed to allow rotation of the handle. The cap portion is secured in the handle by screws or other threaded members extending from the handle base portion interface into the cap.

In an alternative embodiment, the first release mechanism comprises a trigger portion which pivots with respect to the handle, and the second release mechanism slides linearly with respect to the handle.

The trigger portion of the first release mechanism is pivotally connected to the handle of the latch mechanism and includes a first interference portion or detent which extends forwardly into a first slot of the base to prevent rotational movement of the handle relative to the base.

The slide portion of the second release mechanism includes a second interference portion or detent, and is operatively connected to the obstructing member of the axially rotatable second release mechanism so that upon rotational movement of the second release mechanism, the second interference portion is brought into and out of engagement with the first slot in the base. Second interference portion also prevents rotational movement of the handle relative to the base.

The trigger and slide portions are arranged so that the first and second interference portions are juxtaposed within the first slot in the base so that the second interference portion prevents the first interference portion from being disengaged from the first slot in the base. When the second release mechanism disengages the second interference portion from the first slot in the base, the first interference portion of the first release mechanism may be pivoted out of engagement with the first slot of the base, thus enabling the handle to be rotated to engage or disengage the latch member from the latch receiver.

A feature and advantage of the invention is that a finger operated slide member must be depressed into the handle before rotation of the handle.

A feature and advantage of the invention is that a release mechanism positioned in the head of the handle must rotate to allow the handle to be rotated.

A further feature and advantage of a preferred embodiment is that the release shaft portion must be rotated before the finger operated slide member may be depressed into the handle.

A further feature and advantage of the invention is that the handle when rotated to the unlatched seconded position is retained in place by the slide member engaging a second detent recess.

A further feature and advantage of the invention is that the handle is easily convertible from a clockwise unlatching rotation to a counterclockwise unlatching rotation by simple internal alteration. The same latching assembly can thus be used for either right or left hand opening doors.

A feature and advantage of the invention is that with the same handle, base portion, and shaft, a blank plug may be inserted into the head of the handle eliminating the release shaft portion such that the latching assembly may be operated with one hand.

A feature and advantage of the invention is that the release shaft portion may utilize a key operated insert, either radial pin-tumblers or normal flat key cylinders.

An additional advantage and feature of the invention is that three separate actions are required to unlatch the latching assembly and only a single action, rotation of the handle is necessary for latching the latching mechanism.

DETAILED SPECIFICATION

Figures 1, 2:
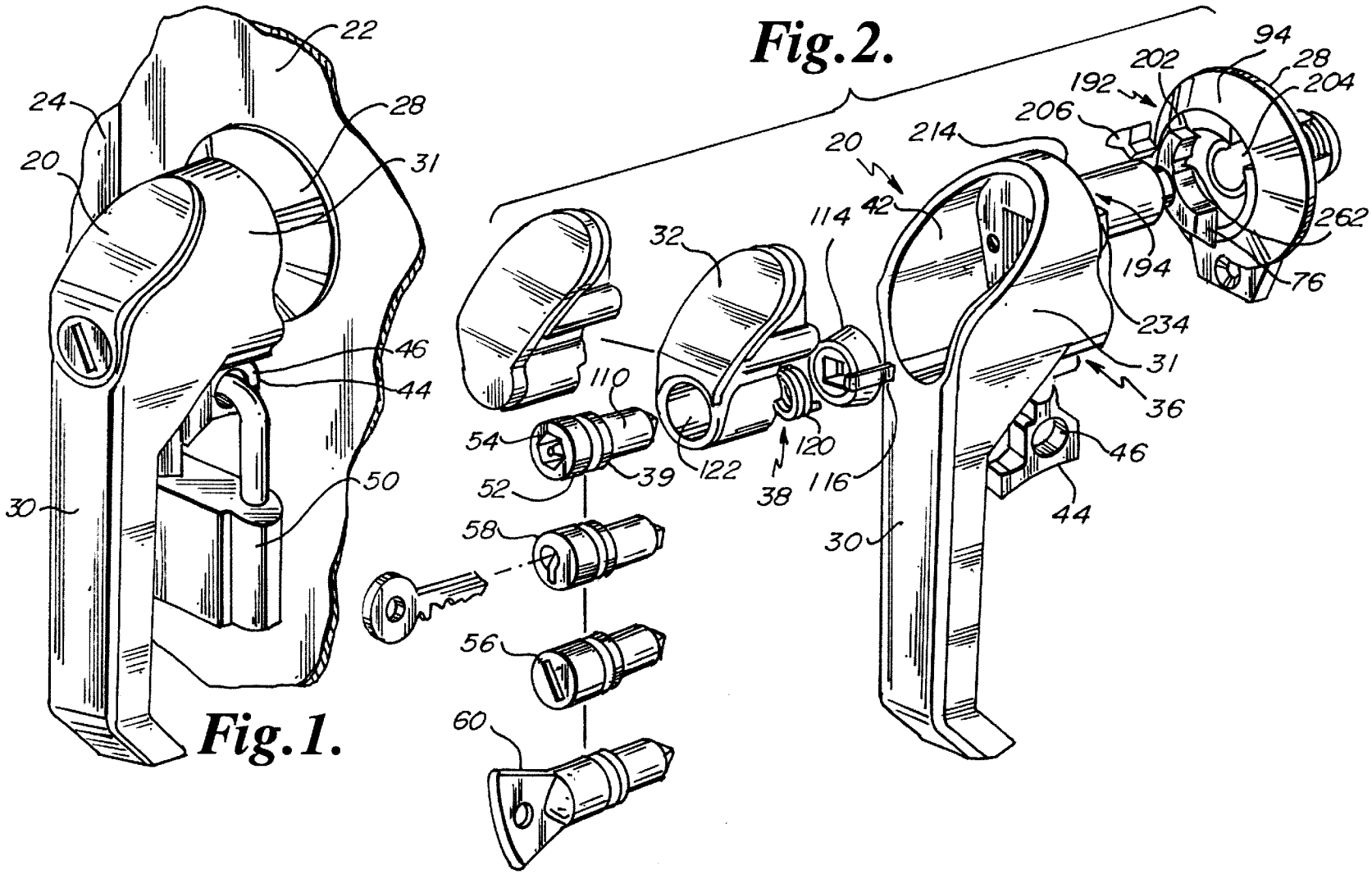
FIG. 1 is a perspective view of the latch assembly in place on a door with a padlock.
FIG. 2 is a exploded perspective view of the latch assembly showing alternative shaft portion ends.

Referring to FIGS. 1 and 2, the latching mechanism is shown in position on a door and in an exploded view. The latching mechanism is generally designated with the numeral 20 and is tended to be secured to a door 22 in a door frame 24. The latching mechanism is principally comprised of a base portion 28, with a sleeve 29 defining an aperture 33 sized to rotatingly retain a shaft, a handle 30, a plug or cap 32, a shaft 34, a first release mechanism 36 and a second release mechanism 38. The handle as a head portion 31 with an open interior configured as a cap or plug receiving region 42.

Figure 4:
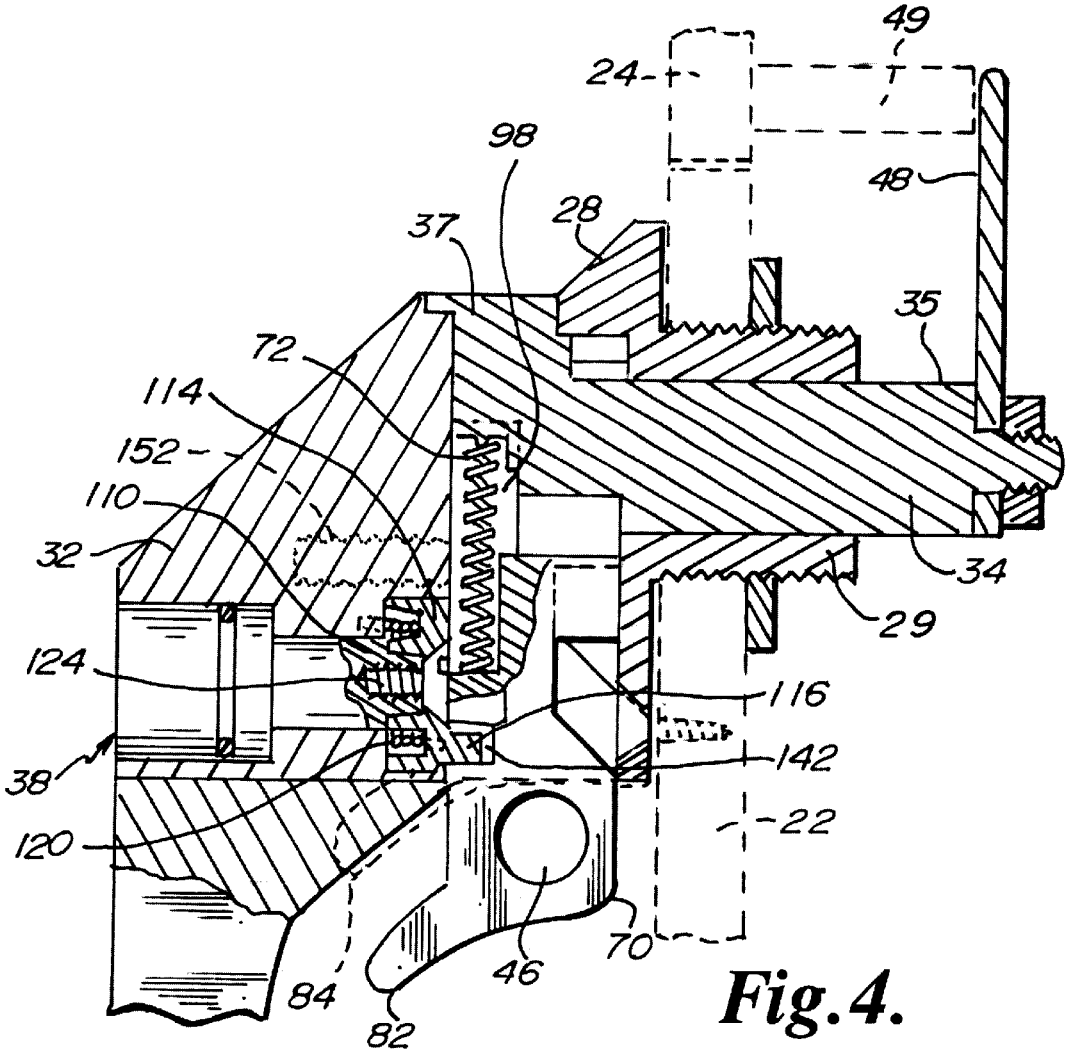
FIG. 4 is a cross-sectional view through the device.

The first release mechanism 36 is a detent mechanism in the preferred embodiment and has a protruding portion configured as a trigger portion 44 which comprises a loop 46 sized for receiving a padlock 50. The second release mechanism 38 has a first end 31 which may be a tool receptacle 54, 56 or a key cylinder 58 or a manually manipulatable member 60 and a second end that interferes or obstructs the operation of the detent mechanism. Thus, the rotation of the handle and the actuation of the latch member 48 involves sequential actuation of the second release mechanism by rotation of the first end and depression of the trigger portion 44 at which point the handle 30 may be partially rotated to release an internal latch member 48 from a latch receiver 49 as shown in FIG. 4. The shaft 34 has a first end 35 and a second end 37 and may have any conventional configuration with the latching member 48 attached to the first end 35 by any suitable means, the shaft received for rotational movement in the aperture 33 of the base portion 28.

Figure 3A:
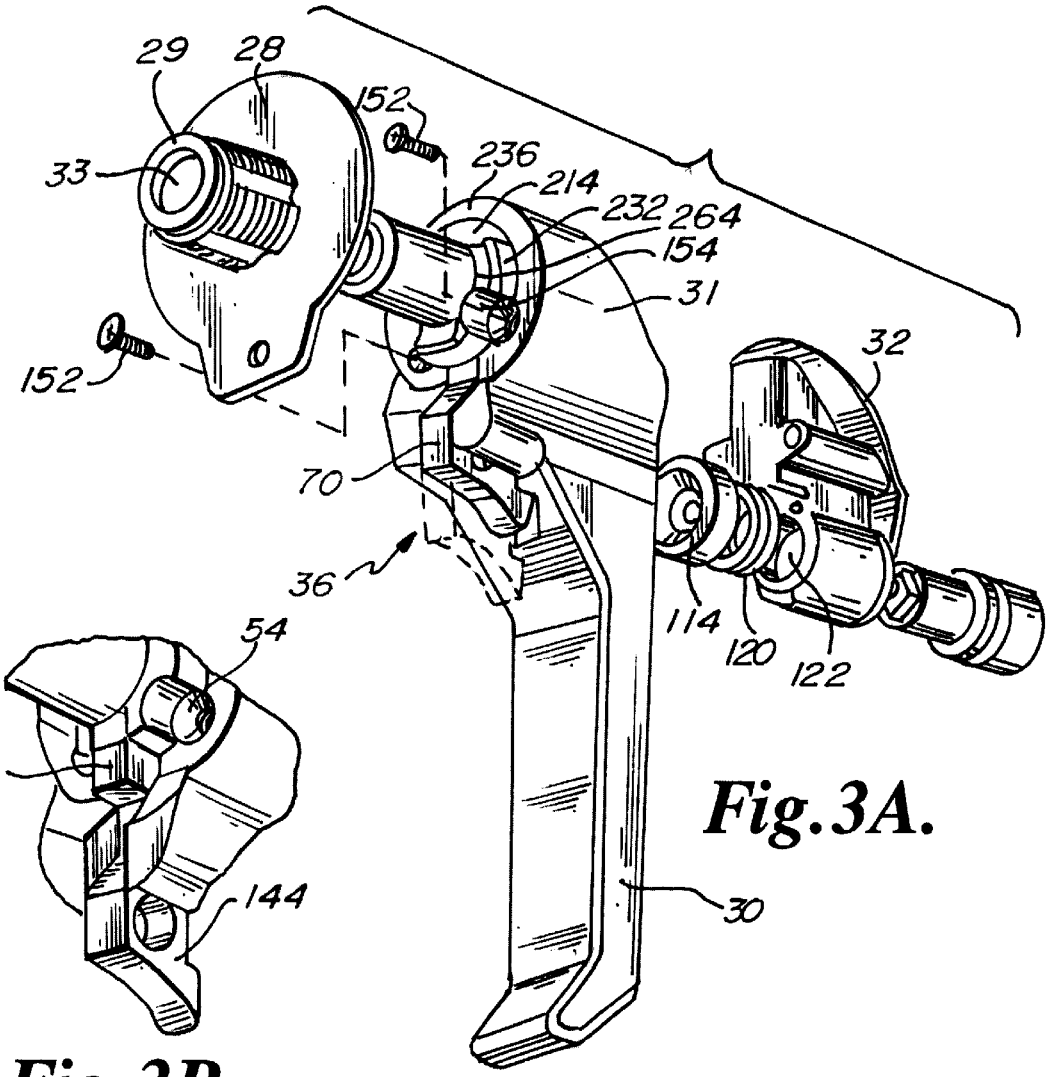
FIG. 3A is an exploded perspective view of the invention.
Figure 3B:
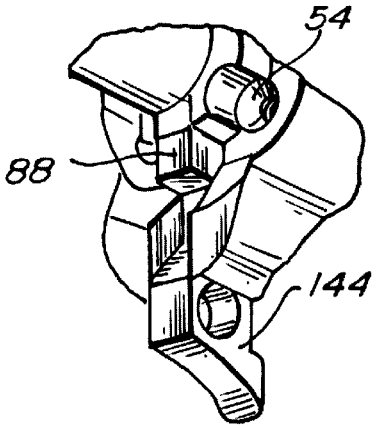
FIG. 3B is a portion of FIG. 3A with the trigger portion in a different position.

Details of the first release mechanism are as follows. Referring to FIGS. 3A, 3B, 3C, 4, 5, 6, and 7, the components of the first release mechanism 36 are the finger operated slide member 70 which is shown in isolation in FIG. 3C, the spring 72, which provides a downward bias to the slide member 70, the base portion 28, specifically the first slot 76, the handle 30, specifically the second slot 80. Due to this bias, the slide member 70 is normally in the extended position as shown in FIGS. 3B and 4 in the solid lines and is indicated with the numeral 82. The depressed position as shown in FIG. 3A in slotted lines and in FIG. 4 in dashed lines has been designated with the numeral 84.

Note that the slide member has regions of a reduced cross sectional portion 85 where the protruding portion extends from the head of the handle whereby when the protruding portion receives a sharp impact such as from someone trying to remove the padlock, the slide member tends to fracture at said reduced cross sectional portion inhibiting further movement of the slide member from the extended position to the depressed position.

The slide member 70 has an interference portion or detent 88 which in the extended position is positioned in the slot 76 preventing rotation of the handle 30 and shaft 34 with respect to the base portion 28. Depression of the trigger portion 44 extends the detent 88 upwardly out of the way of the frustoconically shaped collar portion 94 of the base portion 28. In such a position the recess 96 on the slide member which conforms to the shape of said frustoconical portion of the base portion freely rotates about the exterior of said frustoconical portion as the handle is rotated. The spring is contained in a spring containment region 98.

The second release mechanism 38 is best shown in FIGS. 2, 3A, 4, and 6. The mechanism 38 has a shaft portion 110 which is comprised of the rotatable portions such as the first end 39 to the opposite end 114 which is configured as a cylindrical member with an obstructing portion 116.

A torsion spring 120 is engaged with the cylindrical member 114 and the cap 32 is constrained by and fits in the bore 122. A screw 124 secures the cylindrical member 114 to the first end of the shaft portion. The obstructing portion 116 rotates with the shaft portion between an obstructing position as indicated with the numeral 130 and a non-obstructing position as indicated with the numeral 132. The handle has a recess 134 in which the obstructing member travels and has a first stop portion 136 and a second stop portion 138 both of which in the preferred embodiment are integral with the handle 30. The obstructing portion 116 in the obstructing position engages with the slot 142 of the slide member 70. The second release mechanism is secured within the head of the handle portion 30 by securing the cap 32 to the handle head by way of screws 152 in the screw recesses 154 as best shown in FIG. 3A.

Figure 9:
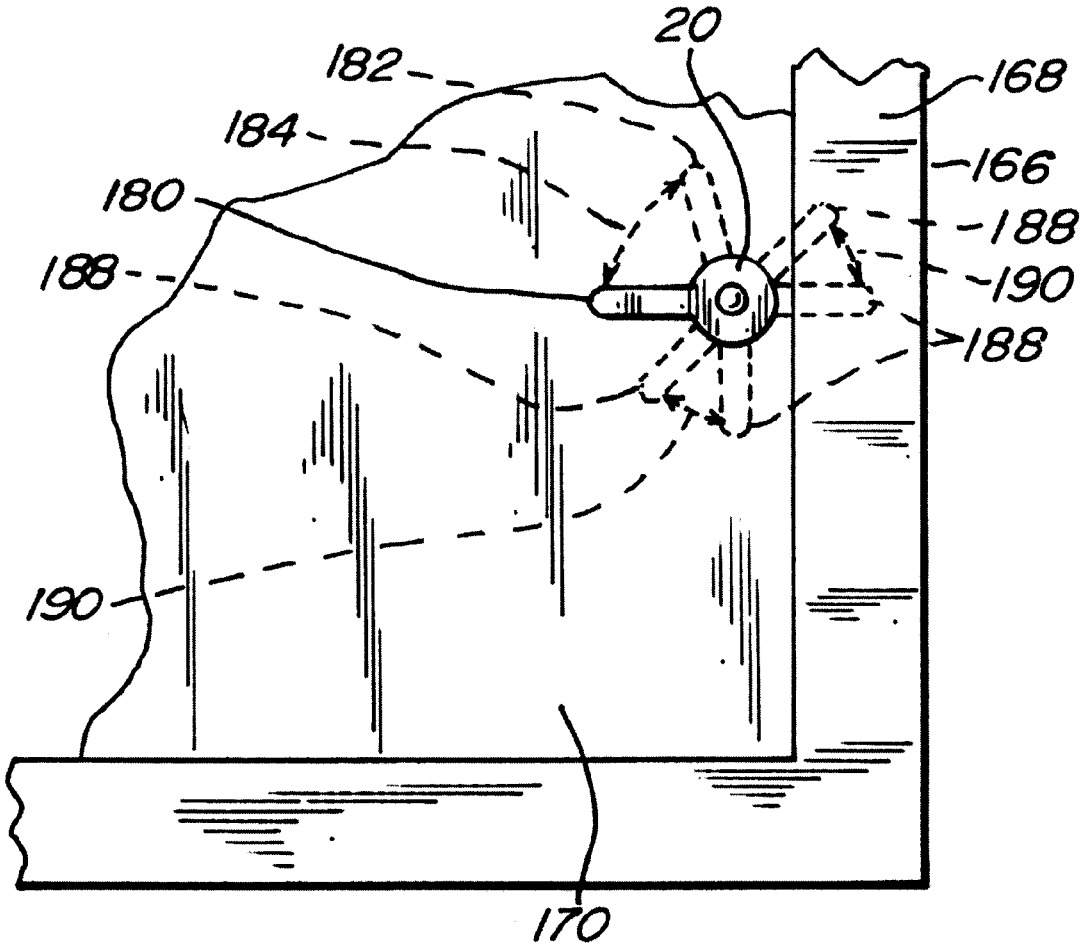
FIG. 9 is a schematic view showing different rotational positions of the handle and different range of rotations.
Figure 10:
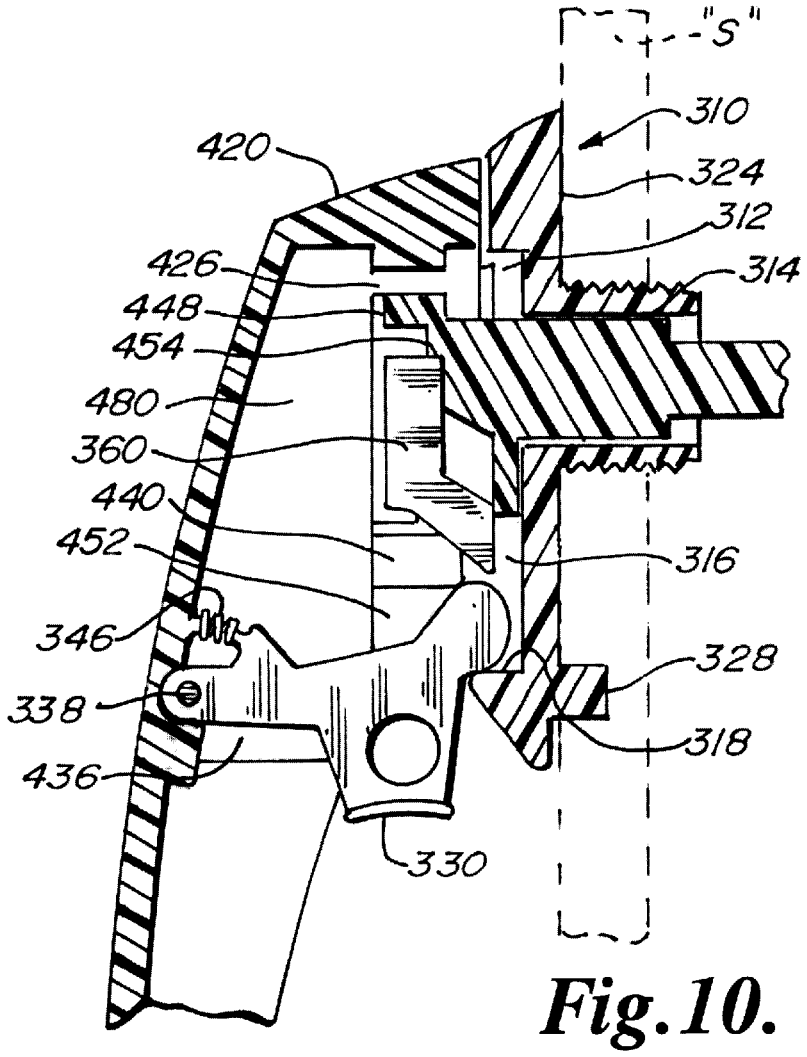
FIG. 10 is a partial, sectional plan view of an alternative embodiment of a release mechanism showing the juxtaposition of a first release mechanism and a second release mechanism relative to the base and the handle of the latch mechanism. The plug or cap containing the second release mechanism has been omitted for clarity.
Figure 11A:
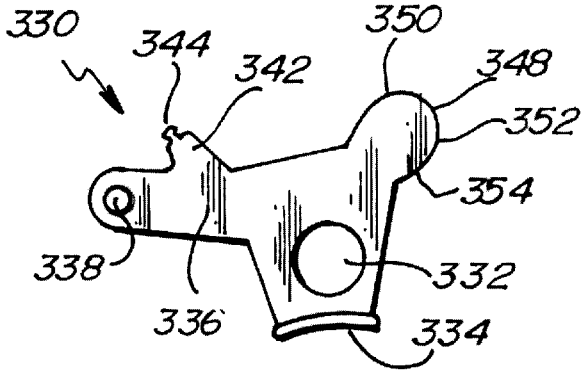
FIG. 11A is a side elevational view of the trigger portion of the first release mechanism of FIG. 10.
Figure 11B:
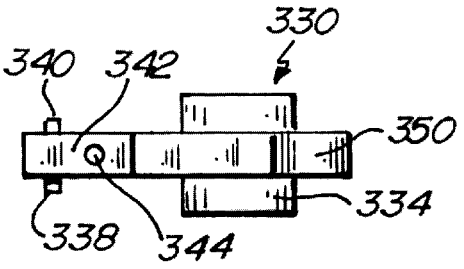
FIG. 11B is a top plan view of the trigger portion of the first release mechanism of FIG. 10.
Figure 12A:
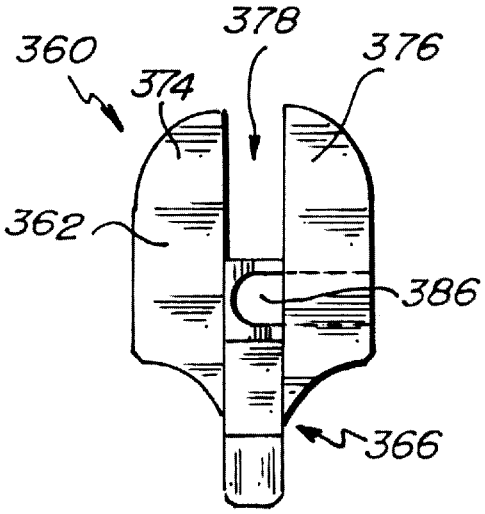
FIG. 12A is a front elevational plan view of the slide portion of the second release mechanism of FIG. 10.
Figure 12B:
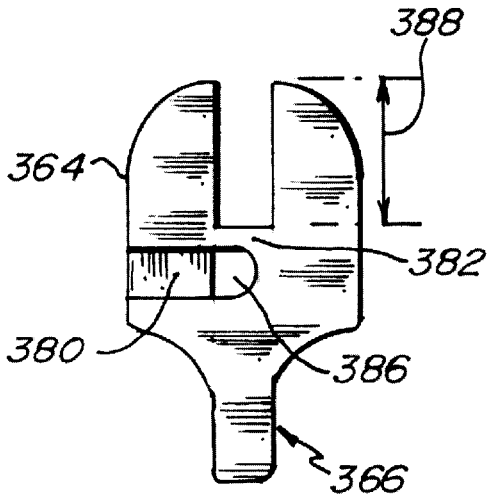
FIG. 12B is a rear elevational plan view of the slide portion of the second release mechanism of FIG. 10.
Figure 12C:
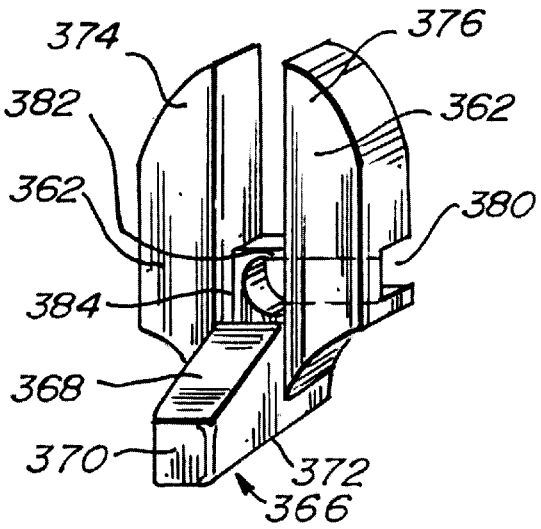
FIG. 12C is a view of the front surface of the slide portion taken from a right perspective.
Figure 12D:
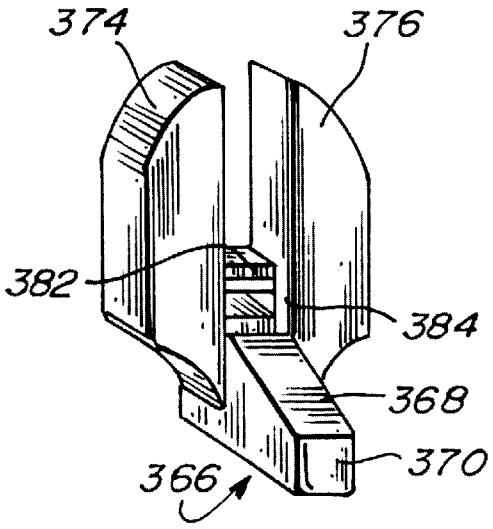
FIG. 12D is a view of the front surface of the slide portion taken from a left perspective.

Referring to FIG. 9 the use of latching mechanism 20 on a cabinet 166 is illustrated. The cabinet has a door frame 168 and a door 170. Several different positions of the handle are shown with respective range of rotations. The handle 30 shown in the first position as indicated by the numeral 180 rotates from the first position to the upright position as indicated by the numeral 182 which is designated the second position and is the unlatched position for the latch assembly. The first position and second position define a range of rotation as indicated by the arrows designated with the numeral 184. Alternative placements of the handle are possible as indicated by the handles drawn in phantom in dashed lines and designated with the numeral 188 which each have their respective range of rotations 190. The different positioning of the handle are possible with the same latch assembly by way of altering the positioning of internal components and by rotating the base portion on the door.

Figure 8:
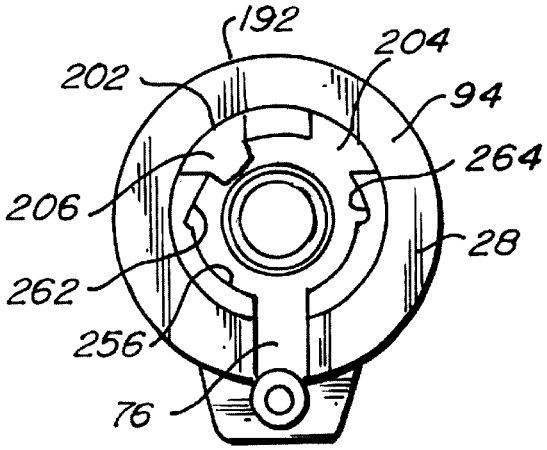
FIG. 8 is a front elevational view of the body portion with a key guide in place.
Figure 7:
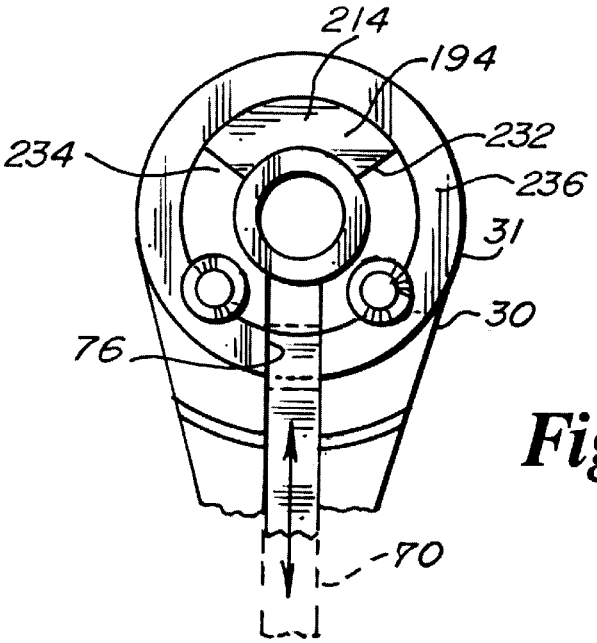
FIG. 7 is a front elevational view of the handle and shaft without the base portion and with the slide member in place.
Figure 5:
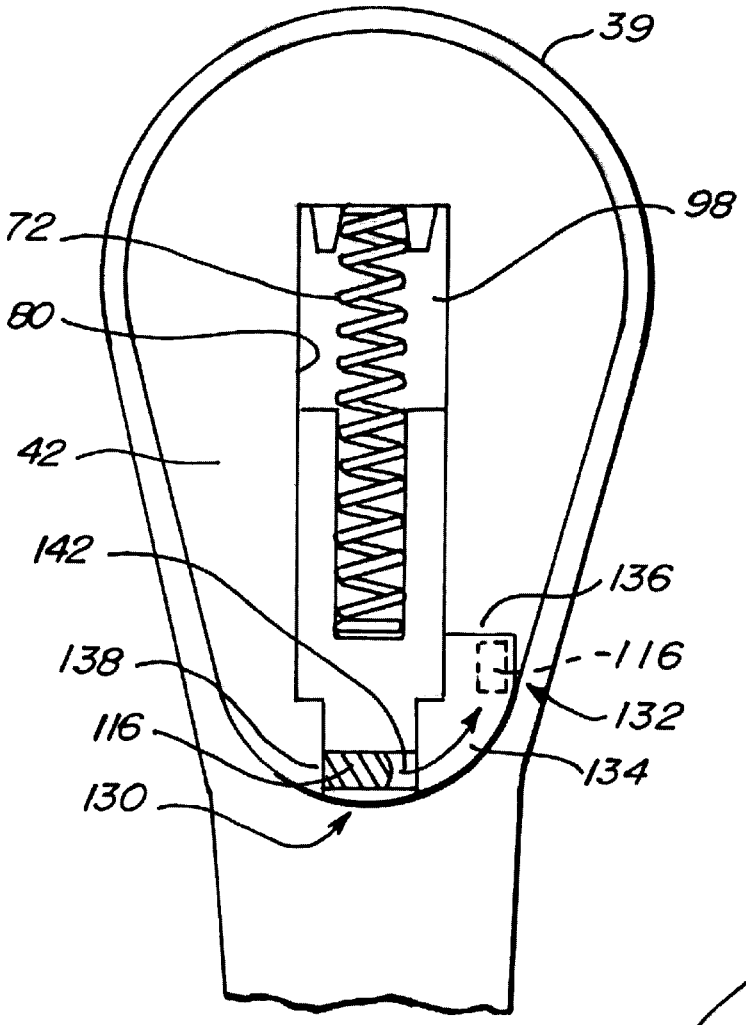
FIG. 5 is an elevational view of the end of the handle with the cap end and shaft portion removed except for the obstructing portion.
Figure 6:
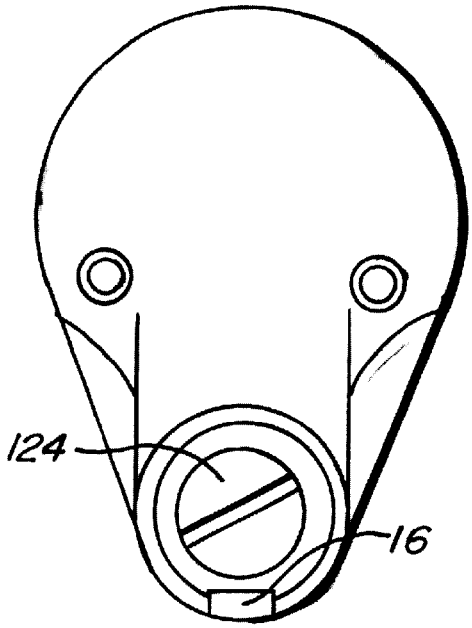
FIG. 6 is an elevational view of the inside of the cap with the shaft portion in place illustrating the obstructing portion.

Referring to FIGS. 2, 7, and 8, the base portion 28 and the handle each have cooperative rotation restriction portions 192, 194 respectively. The cooperative rotation restriction portion 192 on the base portion 28 has alternate seeding recesses 202, 204 each recess 202 and 204 being configured to receive and engage a portion of a guide key 206. The other cooperative rotation restriction portion 194 as best shown on FIG. 7 and as also shown in FIG. 3A, has an open area 214 in which another portion of the guide key 206 is allowed to rotate or arcuately translate. The open area and the range of rotation or arcuate translation of the guide key and thus the handle is defined by the opposing stops 232, 234 which are both integral with the handle in the preferred embodiment. The guide key 206 is shown as a separate component but it also is understood that said guide key can be integral with the base portion. Additionally the cooperating rotation restriction portions can be reversed as to the base portion and the handle. That is the guide key seating recesses 202, 204 could be on the front face 236 of the handle head portion 31 and the stops 232, 234 could be on the base portion 28. Additionally the stop portions could also be separate removable components similar to the guide key 206 to allow alteration or expansion of the range of rotation.

Referring to FIGS. 2 and 8, note that the frustoconical portion 94 of the base portion 28 has an interior surface 256 which is generally cylindrical in shape with the exception of the seating recesses 202, 204 and also to secondary detent recesses 262, 264. As the handle is rotated through its range of rotation, the slide member 70 is in the depressed or retracted position, although it is continually biased outward. Unless the trigger portion is being manually held in the depressed position, this bias outward causes the surface 196 of the detent 88 to continually engage said inside surface 256. At the secondary detent recesses 262, 264, the handle will be held in the specific position correlating to these recesses. For example, the handle as shown in FIG. 1 may be raised to an upright portion which would correspond to the detent 88 positioned in one of said recesses. This will operate to secure the handle in the more horizontal position and prevent the handle from falling to the down vertical position and inadvertently locking the cabinet. Note that the two secondary recesses as shown are applicable only in the convertible latching mechanism in which the guide key or similar means provides reconfiguration of the assembly.

Figure 3C:
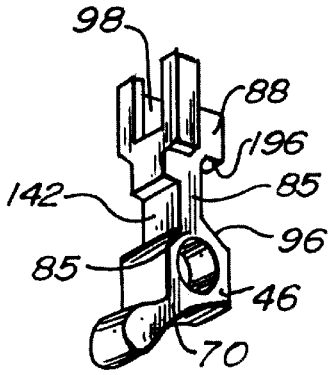
FIG. 3C is a detailed perspective view of the slide member including the trigger portion.

Referring to FIGS. 10, 11A, 11B, 12A, 12B, 12C and 12D, first release mechanism 280 comprises trigger portion 330. Trigger portion 330 is similar to first release mechanism 36 as depicted in FIG. 3C in that it includes a loop 332 sized to accept an additional lock mechanism, and a trigger actuation surface 334. Trigger portion 330 differs from first release mechanism 36 in that it includes an arm 336 which extends rearwardly from trigger portion 330 and terminates in a pivot pins 338, 340. Pivot pins 338, 340 are transverse to arm 336 and allows trigger 330 to move relative to the handle.

Trigger portion 330 includes a first interference portion or detent 348 which is sized to project into and engage first slot 316 shown in base portion 310 to prevent motion of the handle 410 relative to the base 310. First interference portion 348 includes a first contacting surface 350 which confrontingly engages a corresponding contacting surface 372 on second interference portion 366 of slide portion 360. First contacting surface 350 and contacting surface 372 are configured such that if a user attempts to pivotally disengage the first interference portion 348 from first slot 316 without first interface portion 348 slidingly disengaging the second interference portion 366 from the first slot 316, first contacting surface 350 will impinge upon contacting surface 372 and drive second interference portion 366 into slot 316. When first and second interference portions 348, 366 are disengaged from first slot 316 and the handle is rotated with respect to the base, a second contacting surface 352 comes into sliding contact with a handle contacting surface 320 of base 310. First interference portion 348 of trigger portion 330 is biased into locking engagement with slot 316 by spring element 346 which extends between a land 342 and a pocket in the plug or cap 390. One end of spring element 346 is removably attached to land 342 by a spring engaging element or button 344, while the other end of spring element 346 is received in a pocket 402 in plug or cap 390 (see FIGS. 13A and 13B). As spring element 346 biases first interference portion 348 into slot 316, third contacting surface 354 of first interference portion 348 engages a stop 318 at the bottom of slot 316 of base portion 310.

Slide portion 360 includes a first surface 362 and a second surface 364 which are spaced apart from and parallel to each other. Second interference portion 366 projects a sufficient distance from first surface 362 to enable second interference portion 366 to engage first slot 316. Slide portion 360 includes an obstruction portion receiver or race 380 on the second surface of slide portion 360. Race 380, which is generally transverse to notch 378, is provided with a web or sidewall extension 382 which forms a foreshortened portion 388 of the longitudinal aspect of notch 378 and creates an aperture 386 at the intersection of notch 378 and race 380. Web or sidewall extension 382 also defines a land receiving area 384 which spans the distance from web 382 to the lowermost extent of notch 378. The foreshortened portion 388 is sized to slidingly accept a boss 448, and the land receiving area 384 is sized to slidingly accept land 454 so that land 454 effectively closes aperture 386 when slide portion 360 is disengaged from first slot 316.

Race 380 slidingly receives obstruction portion 116 of second release mechanism 38 (as depicted in FIG. 2). Because of the action of torsion spring 120 on obstruction portion 116 of second release mechanism 38, second interference portion 366 is biased into engaging contact with first slot 316. Slide portion 360 includes arms 374, 376 which define a notch 378 and which serve to guide slide portion 360 as is moves linearly within a slide portion receiving area 462 of handle 420 to engage and disengage second interference portion 366 from first slot 316. Arms 374, 376 slidingly interact with corresponding surfaces in slide portion receiving area 462 of handle 420 (see also, FIGS. 14B, 14C).

Figure 13A:
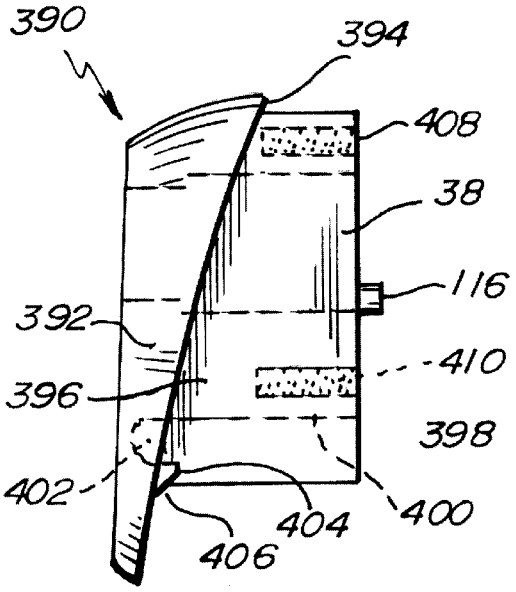
FIG. 13A is a side elevational view of the plug or cap of the alternative embodiment.
Figure 13B:
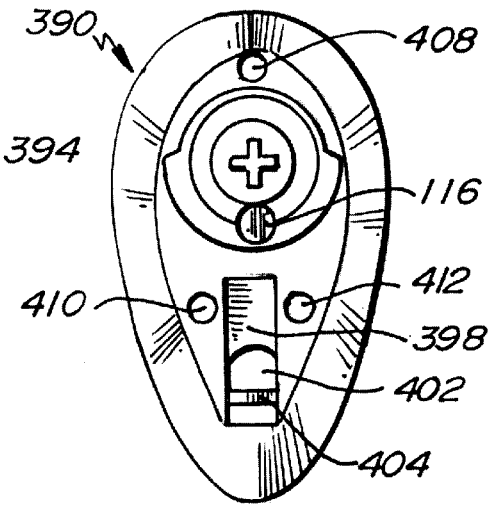
FIG. 13B is an interior facing end view of the plug or cap of the alternative embodiment of FIG. 13A.

Referring to FIGS. 13A and 13B, cap or plug 390 includes an exterior portion 392, a shoulder 394 and an interior portion 396. When assembled with handle 420, interior portion 392 of cap 390 fits into a plug or cap receiving cavity 480 (see FIGS. 10 and 14C). To facilitate assembly, plug or cap 390 is provided with threaded bores 408, 410, 412 (shown in dashed lines in FIG. 13A) which receive threaded fasteners (not shown) inserted into countersunk through holes 426, 430, 434 in handle 420 (see FIGS. 14A and 14B). Cap or plug 320 includes a channel 398 with an upper interior surface 400 configured to allow movement of trigger portion 330 between engagement and disengagement positions. Channel 398 includes a pocket 402 configured to receive spring element 346. Channel 398 includes a flange 404 which serves to lengthen pocket 402. Flange 404 includes a retaining portion 406 which is configured to maintain pivot pins 338, 340 in contact with pivot contacting surfaces 470, 472 (see FIG. 14B) and prevent trigger portion 330 from being pivoted past a predetermined position. First release mechanism 38 (shown in dashed lines in FIG. 13A) has been adequately described above and will not be further discussed. Note that obstructing portion 116 extends beyond the plane of the interior portion 396 of plug 390. Note that when assembled, obstructing portion 116 will be slidingly retained within race 380. As obstructing portion 116 moves radially about a predetermined range of motion, slide portion 360 will be translated into linear motion.

Figure 14A:
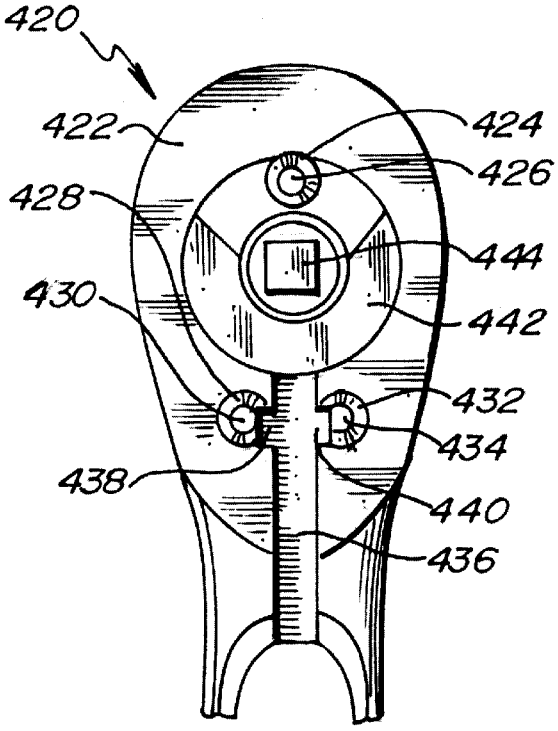
FIG. 14A is a partial plan view of the base engaging side of the handle of the alternative embodiment.

Referring to FIG. 14A, base engaging surface 422 of handle 420 includes through holes 426, 430, 434 with countersinks 426, 428, 432 which are sized to passingly accept threaded fasteners (not shown) used to secure plug 390 to handle 420. A cylindrically shaped land 442 with a longitudinal axis projects away from base engaging surface 422. A shaft 444, onto which a latch may be affixed, extends coaxially along the longitudinal axis of cylindrically shaped land 442. A slot 436 extends from the longitudinal axis of land 224 in a generally radial direction along the longitudinal aspect of base engaging surface 422. Slot includes notches 438, 440 which are sized to accommodate pivot pins 338, 340 of trigger portion 330 to facilitate assembly.

Figure 14B:
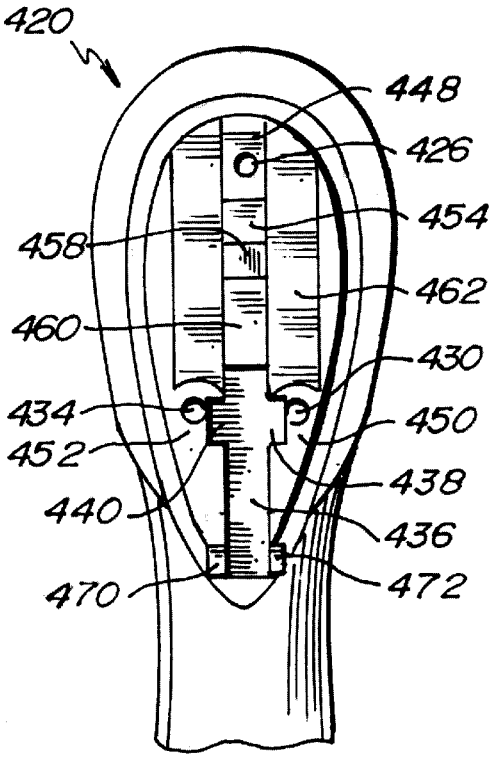
FIG. 14B is a partial plan view of the interior chamber of the handle of the alternative embodiment.

Referring to FIG. 14B, hole 426 extends through boss 448, hole 430 extends through boss 450, and hole 434 extends through boss 452, which contact interior portion 396 of plug 390 and effectively retain slide portion 360 within slide portion receiving area 460. Range of linear motion of slide portion within the slide portion receiving area 460 is limited by bosses 448, 450, 452.

Figure 14C:
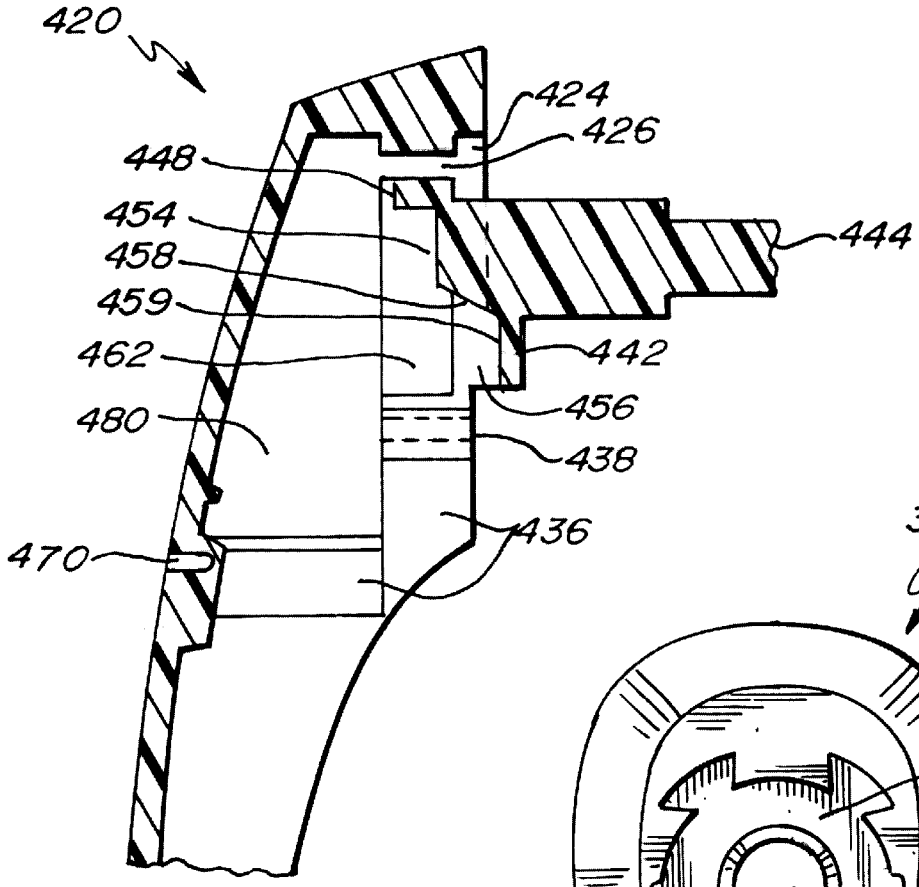
FIG. 14C is a partial sectional side view of the handle of the alternative embodiment taken along line A—A of FIG. 14A.

Referring to FIG. 14C, slide portion receiving area 462 includes a rectilinear shaped land 454, a ramp 458, and a recess 456 with a contacting surface 460. Rectilinear shaped land 454 extends inwardly from the plane of the slide receiving area 462 by a distance which allows passage of web 382 of slide portion 360 thereabove. Ramp 458 extends outwardly and downwardly from land 454 and terminates at contacting surface 460 which is parallel to and spaced from the plane of the slide receiving area 462, the ramp 458 and contacting surface 460 define a recess 456. Recess 456 is sized to slidingly accept angle portion 368 and forward facing portion 370 of slide portion 360 when slide portion 360 is disengaged from slot 316 of base 310. Pivot contacting surfaces 470, 472 are generally semicircular in shape to facilitate assembly.

Figure 15A:
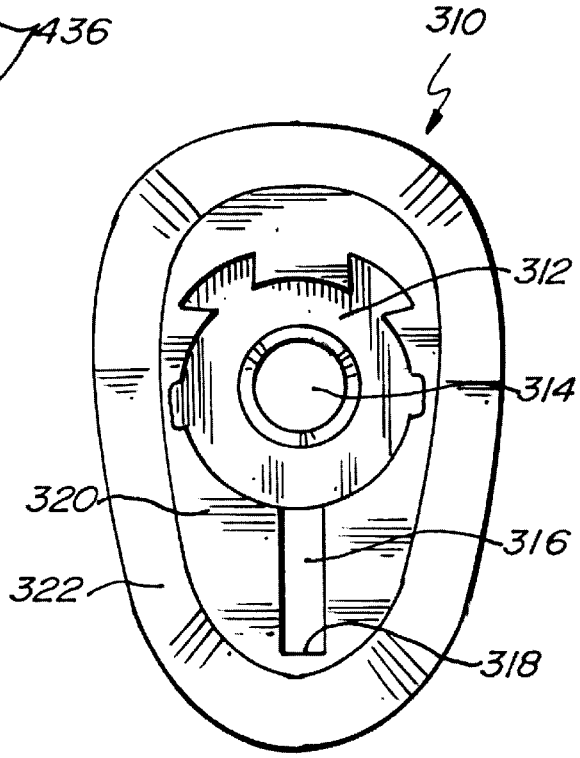
FIG. 15A is a plan view of the handle engaging side of the base of the alternative embodiment.
Figure 15B:
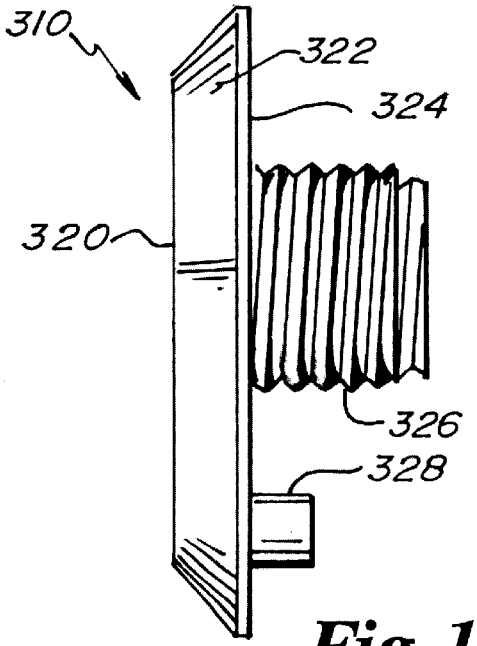
FIG. 15B is a side elevational view of the base of FIG. 15A.

Referring to FIGS. 15A and 15B, base portion 310 includes a cylindrically shaped land receiving section 312 with a coaxially aligned aperture 314 configured to rotatingly accept cylindrically shaped land 442 and shaft 444 of handle 420. Contiguous with, and extending radially from the cylindrically shaped land receiving section 312 is slot 316 which terminates in stop 318. Adjacent to, and coplanar with land receiving section 312 is handle contacting surface 320. Handle contacting surface 320 also slidingly supports second contacting surface 352 of trigger portion 330 when handle 420 is rotated relative to base 310. Parallel to handle contacting surface 320 is support or door contacting surface 324. Handle contacting surface 320 and support contacting surface are spaced apart from each other by a transition 322. Support contacting surface 324 includes a threaded hollow shaft 326 which extends outwardly therefrom and which is sized to rotatingly accept shaft 444 of latch mechanism. Shaft 326 is attached to a support by a threaded nut (not shown). Support contacting surface 324 also includes an index pin 328 which extends outwardly therefrom collaterally with shaft 326.

The term "slot" when used herein includes any opening accessible by a sliding member such as bores, grooves or the like. The term "substantially" when used herein includes precisely that which is specified as well as not wholly or slightly more than that which is specified. The term "shaft portion" may be an integral piece or may be an assembly. The term "portion" when used herein may be part of an integral component, a separate component, or a combination of components and/or parts of components. The term "mechanism" when used herein may be a single integral piece or more than one linked or engaged pieces.

The components parts may be conventionally formed from appropriate metals such as aluminum, steel, stainless steel, and zinc. Additionally, components may be machined or molded form suitable plastics.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A latch assembly for attachment to a door in a door frame, the latch assembly comprising:

a) a base portion for attachment to the door, the base portion extending through the door;

b) a shaft extending through the base portion, the shaft having a latch engaged thereto for latching with respect to the door frame;

c) a handle fixed to the shaft whereby the handle and shaft are at least partially rotatable with respect to the base between a first position and a second position, the handle having a head portion connecting to the shaft, a grasping portion extending from the head portion, the head portion configured for engagement with the base portion;

d) a first release mechanism positioned in the head portion and having a protruding portion extending from said head portion, the first release mechanism pivotally mounted to the grasping portion of the handle and movable relative to the handle, the first release mechanism having a release position and an interference position, e) a slide member, the slide member having a contacting surface and at least one interference portion, the slide member being vertically movable between a slide member release position and a slide member interference position, the at least one interference portion interfering with the rotation of the handle and shaft when the slide member is in the slide member interference position, the slide member being in contact with the first release mechanism and with the head portion; and f) a second release mechanism positioned in the head portion, the second release mechanism having an engaged position and an unengaged position, the second release mechanism configured such that when in the engaged position the second release mechanism interferes with the rotation of the handle and shaft with respect to the base portion, the second release mechanism further configured such that when in the unengaged position, the handle and shaft may be rotated between the first position and the second position.

2. The latch assembly of claim 1, wherein the protruding portion comprises a loop for receiving a padlock.

3. The latch assembly of claim 2, wherein the slide member further comprises a reduced cross sectional portion where the protruding portion extends from the head portion of the handle whereby when the protruding portion receives an impact the slide member tends to fracture at said reduced cross sectional portion inhibiting movement of the slide member from the slide member interference position to the slide member release position.

4. The latch assembly of claim 2, wherein the handle and shaft rotation is preceded by the first release mechanism being placed in the release position and then the second release mechanism being placed in the unengaged position.

5. The latch assembly of claim 2 wherein the handle and shaft rotation is preceded by the second release mechanism being placed in the unengaged position and then the first release mechanism being placed in the release position.

6. The latch assembly of claim 2 further comprising a biasing member which biasedly holds the first engagement mechanism in the interference position.

7. A latching assembly for a door which engages a door frame, the door having an interior and an exterior, the assembly comprising a base portion which attaches to the door and extends through the door; a shaft which extends through the base portion and the door, the shaft at least partially rotatable with respect to the base portion and the door; a handle connecting to the shaft portion and having a grasping portion extending substantially normally to the shaft portion allowing at least partial rotation of said shaft portion as the handle is rotated; a first release mechanism comprising a trigger portion extending from the handle, a slide member, the slide member having a contacting surface in contact with the trigger portion, the slide member slidably engagable to a recess in the base portion thereby preventing rotation of the handle and shaft with respect to the base portion, said slide member configured to release from the recess by movement of the trigger portion toward the handle.

8. A latch assembly for attachment to a door in a door frame, the latch assembly comprising:

a) a base portion attachable to a door, the base having a through hole and a radial slot extending from an aperture in the base;

b) a handle, the handle having a shaft attached thereto, the shaft rotatingly received by the aperture in the base; the handle having a pivotally mounted first release mechanism, the first release mechanism having a first interference portion vertically engagable with a contacting surface of a slide member, the slide member having an extension which engages the radial slot of the base; the handle having a second release mechanism, the second release mechanism having a second interference portion engagable with the radial slot of the base;

wherein, the first and second interference portions prevent relative rotation between the handle and the base when the slide member and second interference portions engage the radial slot; and, wherein the handle may be rotated relative to the base when the slide member and the second interference portions are disengaged from the slot.

9. The latch assembly of claim 8, wherein the extension and the second interference portions are biased into engagement with the radial slot.

10. The latch assembly of claim 9, wherein disengagement of the extension from the radial slot is dependent upon prior disengagement of the second release mechanism from the radial slot.

11. The latch assembly of claim 9, wherein the base further comprises an index pin, the index pin projecting into the surface of a door to prevent rotation of the base relative to a door.

12. A latching assembly for a door comprising:

a base portion which attaches to the door and extends through the door, the base portion having a radial slot;

a shaft which extends through the base portion and the door;

a handle connecting to the shaft portion and having a grasping portion extending substantially normally to the shaft portion;

a first release mechanism comprising a trigger and a slide member, the trigger extending from the handle, the slide member having a contacting surface in contact with at least a portion of the trigger, a portion of the slide member engageable to the radial slot; and a second release mechanism, the second release mechanism comprising an interference portion, the interference portion engageable to the radial slot.

13. A latching assembly of claim 12 wherein the first and second interference portions prevent relative rotation between the handle and the base when the slide member and second interference portions engage the radial slot; and, wherein the handle may be rotated relative to the base when the slide member and the second interference portions are disengaged from the slot.

14. The latch assembly of claim 13 wherein the handle and shaft rotation is preceded by the portion of the slide member being disengaged from the radial slot as a result of the trigger being moved toward the handle and then the interference portion being removed from the radial slot.

15. The latch assembly of claim 13 wherein the handle and shaft rotation is preceded by the interference portion being removed from the radial slot and then the portion of the slide member being disengaged from the radial slot as a result of the trigger being moved toward the handle.

16. The latch assembly of claim 12, wherein the latch assembly further comprises a protruding portion, the protruding portion including a loop for receiving a padlock.

* * * * *